US008157092B2

(12) United States Patent
Christopher

(10) Patent No.: US 8,157,092 B2
(45) Date of Patent: Apr. 17, 2012

(54) CASE FOR HOLDING A HAND TOOL

(75) Inventor: Brent Christopher, Portland, OR (US)

(73) Assignee: Meridian International Co., Ltd. (CN)

( * ) Notice: Subject to any disclaimer, the term of this patent is extended or adjusted under 35 U.S.C. 154(b) by 0 days.

(21) Appl. No.: 12/789,158

(22) Filed: May 27, 2010

(65) Prior Publication Data

US 2011/0226648 A1 Sep. 22, 2011

(30) Foreign Application Priority Data

Mar. 19, 2010 (CN) ..... 2010 2 0137687 U
Mar. 19, 2010 (CN) ..... 2010 2 0137698 U

(51) Int. Cl.
*B65D 85/28* (2006.01)

(52) U.S. Cl. ..... 206/374; 206/349

(58) Field of Classification Search ..... 206/230, 206/207, 372–379, 349, 765, 763, 1.5, 497; 81/3.07, 3.25, 2, 52, 13, 8.1, 15.9; 7/165, 7/167–168, 28, 57.1, 61, 131
See application file for complete search history.

(56) References Cited

U.S. PATENT DOCUMENTS 1,177,072 A 3/1916 Warman
4,682,688 A 7/1987 Budert
4,899,877 A * 2/1990 Kiernan ..... 206/349
4,924,733 A 5/1990 McKenzie
5,174,178 A 12/1992 Disston, Jr.
5,279,417 A 1/1994 Seaton
5,606,897 A * 3/1997 Quinn ..... 81/124.6
5,740,706 A 4/1998 Tseng
5,743,395 A 4/1998 Backer
5,816,401 A 10/1998 Vasudeva et al.
5,899,329 A * 5/1999 Hu et al. ..... 206/376
5,918,741 A 7/1999 Vasudeva
6,079,298 A * 6/2000 Gasperi et al. ..... 81/63.1
6,237,451 B1 * 5/2001 Wei ..... 81/490
6,457,916 B2 * 10/2002 Wienhold ..... 408/240
6,464,840 B1 * 10/2002 McCann ..... 206/349
6,561,523 B1 * 5/2003 Wienhold ..... 279/30

(Continued)

OTHER PUBLICATIONS

Mar. 31, 2011 USPTO Office Action from related U.S. Appl. No. 12/605,600.

(Continued)

*Primary Examiner* — Mickey Yu
*Assistant Examiner* — Rafael Ortiz
(74) *Attorney, Agent, or Firm* — Jason R. Sytsma; Shuttleworth & Ingersoll, PLC

(57) ABSTRACT

A case for holding a hand tool in a first position wherein the handle projects from the case and engages the hand tool such that the hand tool is prevented from being removed from the case while simultaneously, the handle can be operated with respect to the case to test a function of the hand tool. The case is also adapted to hold the hand tool in a second position wherein the handle fits within the case. The case includes a cover positioned on top of a base, wherein the cover has an opening that when combined with an anti-theft device is adapted to hold the hand tool in the first position. Also included is a base adapted to carry interchangeable bits for the hand tool. The base includes a through hole to allow the working end of the hand tool to pass therethrough and engage a frictional engaging member that opposes a direction of rotation of the working end to test a function of the hand tool.

23 Claims, 5 Drawing Sheets

U.S. PATENT DOCUMENTS

| | | | | |
|---|---|---|---|---|
| 6,685,018 | B1 | 2/2004 | Chuan | |
| 2002/0020537 | A1 | 2/2002 | Shonfeld et al. | |
| 2002/0027092 | A1* | 3/2002 | Hu | 206/378 |
| 2004/0094444 | A1 | 5/2004 | Chen | |
| 2004/0251153 | A1* | 12/2004 | Chen | 206/375 |
| 2005/0189250 | A1* | 9/2005 | Hsu | 206/373 |
| 2005/0247587 | A1 | 11/2005 | Holland-Letz | |
| 2006/0260964 | A1 | 11/2006 | Feldmann | |
| 2007/0023307 | A1* | 2/2007 | Liu | 206/373 |
| 2007/0095690 | A1 | 5/2007 | Nguy et al. | |
| 2007/0163906 | A1 | 7/2007 | Crain | |
| 2007/0228240 | A1 | 10/2007 | Kao | |
| 2008/0110302 | A1 | 5/2008 | Liu | |
| 2009/0236250 | A1* | 9/2009 | Wang | 206/372 |
| 2009/0242443 | A1* | 10/2009 | Chen | 206/375 |
| 2010/0108552 | A1* | 5/2010 | Scrimshaw et al. | 206/379 |

OTHER PUBLICATIONS

Jul. 9, 2010 USPTO Office Action from related U.S. Appl. No. 12/605,600.

European search report dated Oct. 25, 2010 from counterpart European application.

Jul. 21, 2011 USPTO Office Action from related U.S. Appl. No. 12/605,600.

Definition of ratchet from the Merriam-Webster Online Dictionary. http://www.merriam-webster.com/dictionary/ratchet. Accessed Jul. 13, 2011.

* cited by examiner

CASE FOR HOLDING A HAND TOOL

CROSS-REFERENCE TO RELATED APPLICATIONS

The present application claims the benefit of Chinese Application 2010201376989 filed Mar. 19, 2010 and Chinese Application 201020137687.0 filed Mar. 19, 2010, which is incorporated herein by reference.

TECHNICAL FIELD

This invention relates to a multi-functional case for displaying hand tools at a point of sale and storing the hand tool thereafter, and particularly a case that allows a consumer to test the hand tool without removing the hand tool from the case.

BACKGROUND

Tool sets are customarily sold in cases with multiple interchangeably driven bits. The cases are sealed at the point of sale to prevent the hand tool and/or the driven bits from being lost or stolen. Consequently, it is not possible for the consumer to test the hand tool without opening the case and breaking the seal.

Previous disposable packages have been designed to allow the consumer to test a tool while it remains in the package. Such packaging includes scissor type hand tools wherein one handle is exposed and the other loop handle is enclosed in the packaging. The packaging has some room for the working end of the scissors to operate.

SUMMARY

A case for holding and displaying a hand tool at the point of sale is disclosed. The case is adapted to hold the hand tool in a first position wherein the handle projects from the case and engages the hand tool such that the hand tool is prevented from being removed from the case while simultaneously, the handle can be operated with respect to the case to test a function of the hand tool. The case is also adapted to hold the hand tool in a second position wherein the handle fits within the case. The case includes a cover positioned on top of a base, wherein the cover has an opening that when combined with an anti-theft device is adapted to hold the hand tool in the first position. Also included is a base adapted to carry interchangeable bits for the hand tool. The base includes a through hole to allow the working end of the hand tool to pass therethrough and engage a frictional engaging member that opposes a direction of rotation of the working end to test a function of the hand tool.

BRIEF DESCRIPTION OF THE DRAWINGS

These and other features and advantages of the present invention will be better understood by reading the following detailed description, taken together with the drawings wherein.

DETAILED DESCRIPTION

Figure 1:
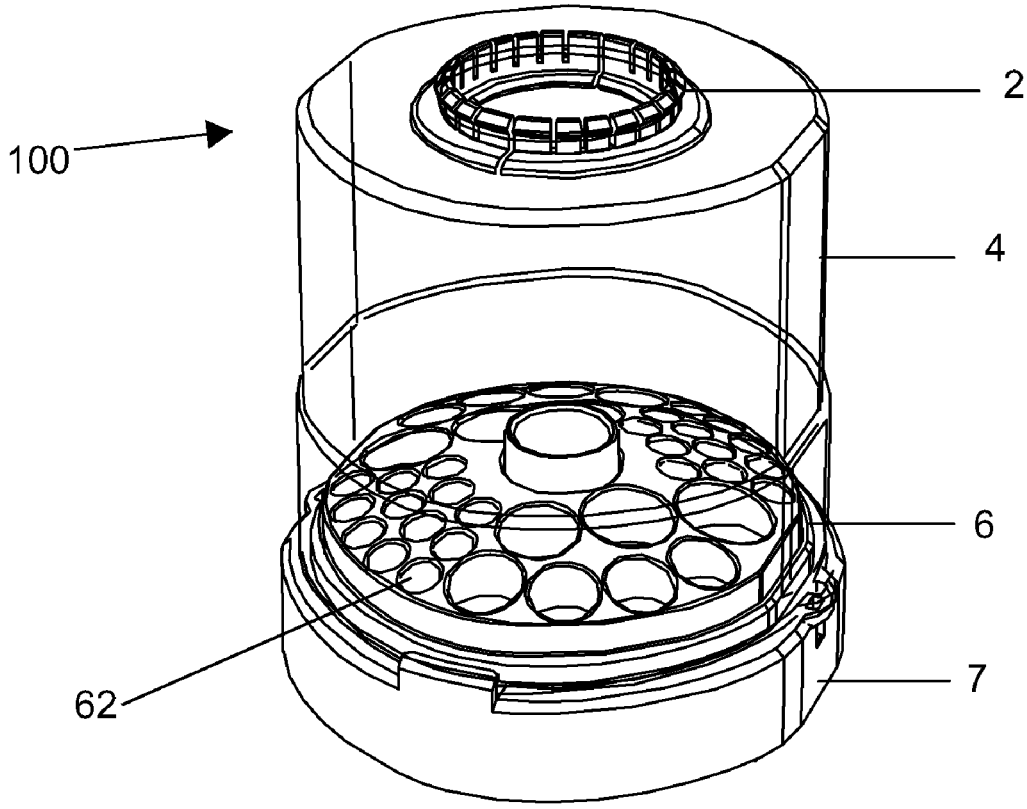
FIG. 1 is a perspective view of the case with the hand tool removed from the case.

Referring to FIGS. 1-4, disclosed is a case 100 for holding a hand tool 200 in two positions. In the first position, the case 100 holds the hand tool 200 with the handle 12 projecting from the case 100. The first position advantageously allows the function of the hand tool 200 to be tested at the point of sale. In the second position the hand tool 200 is separable from the case 100 which functions as a permanent carrying case 100 for the tool and its interchangeable tool bits 61.

The hand tool 200 is comprised of a handle 12, a conical shaped main body 1 beneath the handle 12 and a ratchet head 3 beneath the main body 1. The ratchet head 3 has an extension rod 23, and a retention groove 211 is formed between the ratchet head 3 and the main body 1.

Figure 3:
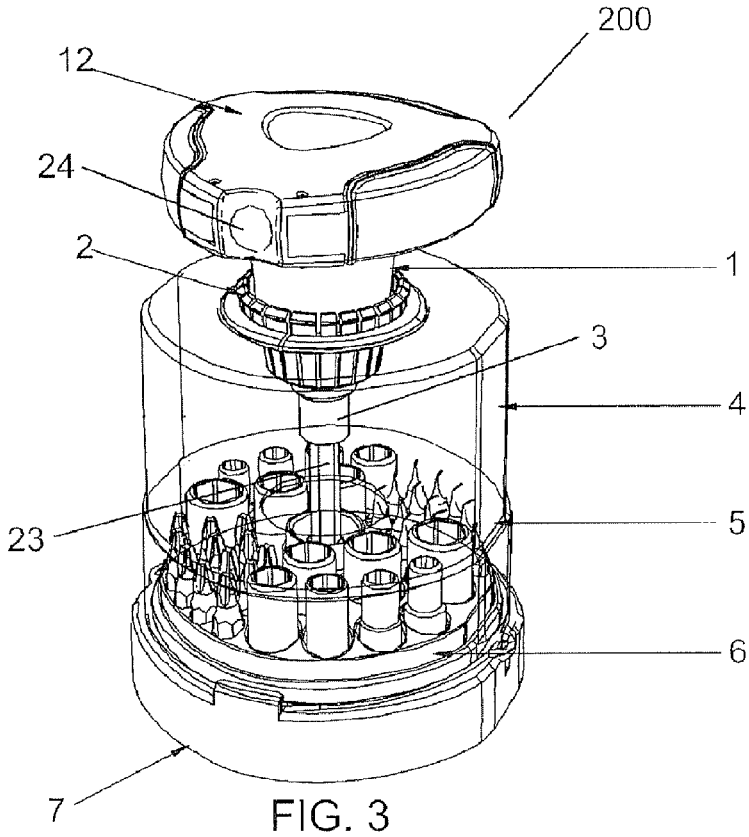
FIG. 3 is a perspective view of the case with the hand tool combined with the case.
Figure 4:
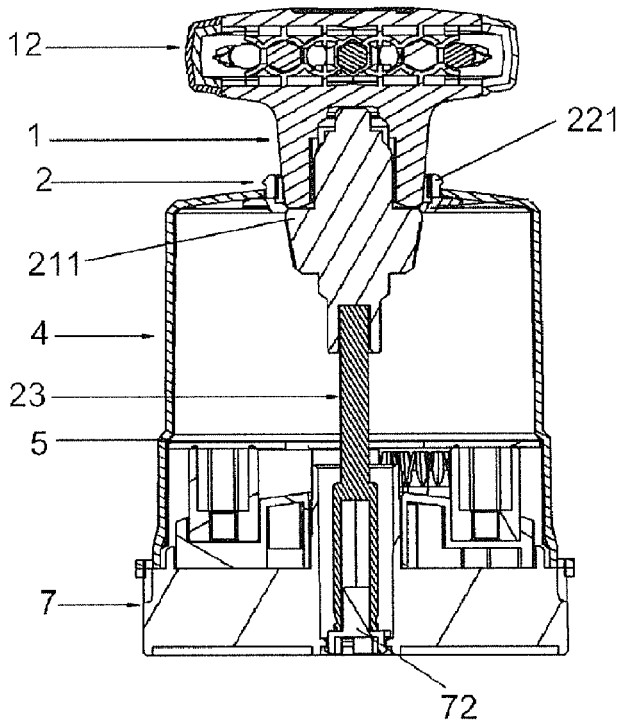
FIG. 4 is a side elevational view of the case and hand tool shown partially in vertical cross section.

FIG. 3 shows the case 100 and the hand tool 200 as encountered by the consumer at the point of sale with the handle 12 projecting from the case 100 and rotatable with respect to the case 100, so that the consumer can test the function of the hand tool 200 before its purchased. FIG. 4 shows the case 100 functioning as a permanent carrying case 100 for the hand tool 200, with the hand tool 200 stored entirely within the case 4. In the illustrative embodiment, the hand tool 200 is a ratcheting driver, and the case contains a plurality of interchangeable bits 61 for use with the driver. The ratcheting driver 200 is stored inside the case 100 with the interchangeable bits 61 to provide a useful, compact, and portable tool set for the user.

Figure 2:
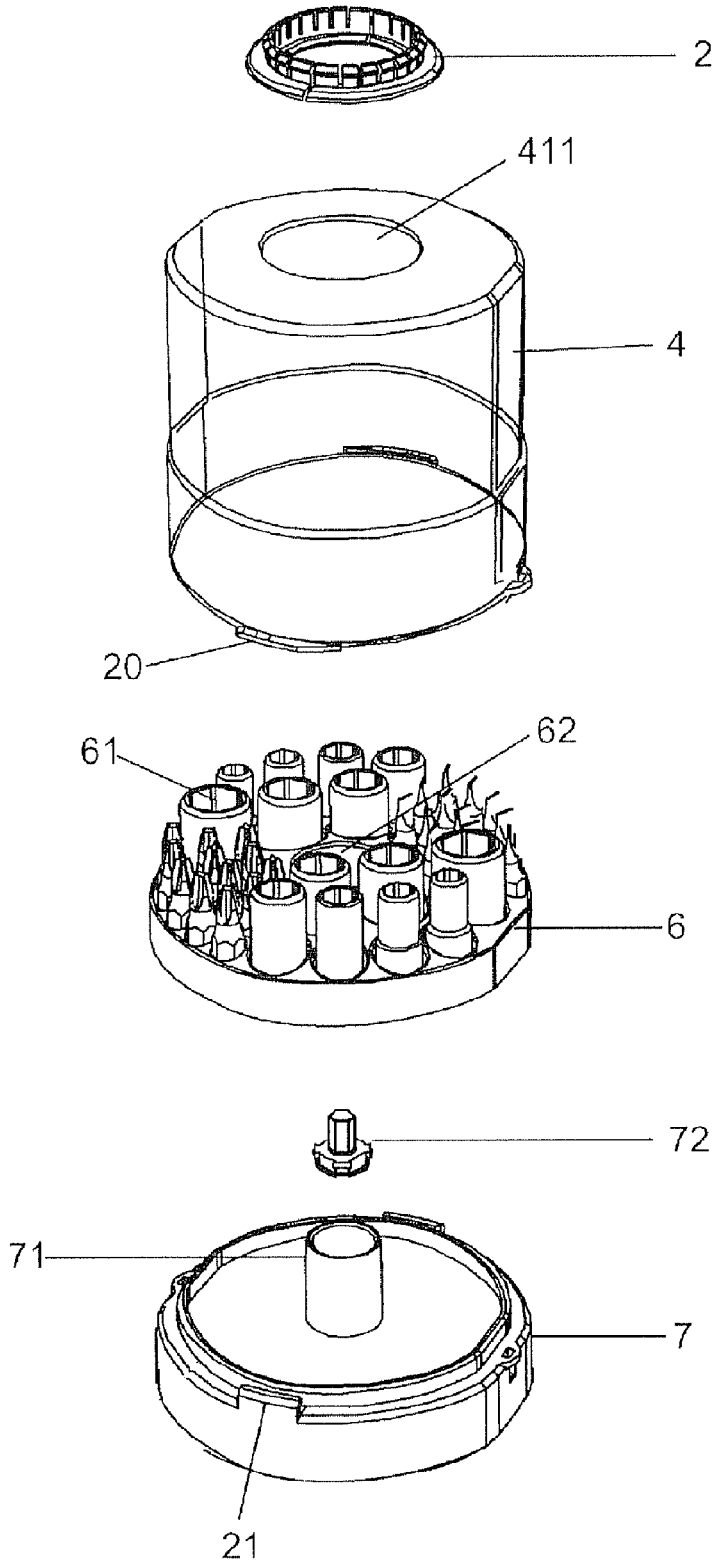
FIG. 2 is an exploded view of the case with the hand tool removed from the case.

Referring to FIGS. 1 & 2, the case 100 is preferably substantially cylindrically shaped and includes a cylindrical base 7 and a cylindrical cover 4 positioned thereon. The cover 4 is removable and selectively lockable to the base 7 by rotating one or more tabs 20 on the cover 4 to engage an equal number of locks 21 on the base 7. Furthermore, the cover 4 is transparent so that the hand tool 200 and the interchangeable bits 61 are visible to the consumer. The base 7 has affixed to it or formed with it a central hollow pillar 71 adapted to receive the end of the extension rod 13 when the unit is fully assembled.

The case 100 is also designed to carry interchangeable bits 61 for the hand tool 200. A retainer 6 inside the case 100 provides a receptacle for the interchangeable bits 61. The retainer 6 resting on the base 7 has a plurality of pockets 62 arranged around its top for holding the interchangeable bits 61. The pockets 62 may be individually sized to mate with individual interchangeable bits 61. The retainer 6 also has a through hole 62 in its center to allow the extension 23 of the hand tool 200 to pass therethrough. The retainer 6 may be fixed to the base 7 or formed as an integral part of the base 7 or removable from the base 7. An optional removable plastic cover 5 for the interchangeable bits 61 may be provided to prevent the interchangeable bits 61 from being displaced when the case 100 is turned upside down.

Figure 6:
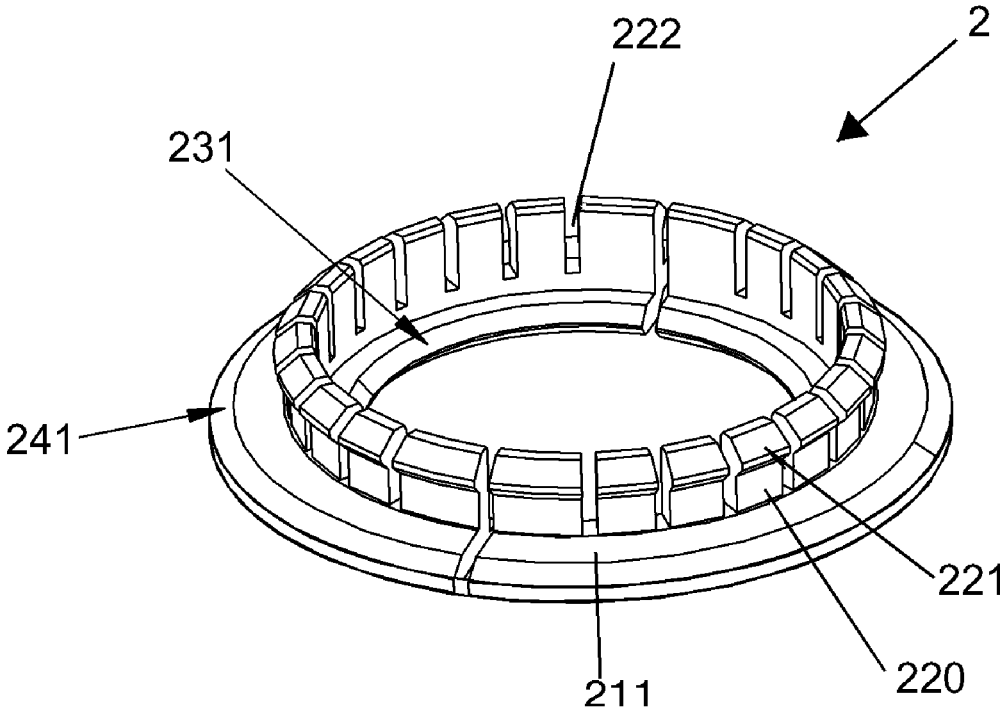
FIG. 6 is a perspective view of the anti-theft ring.

An anti-theft ring 2 combines the hand tool 200 with the cover 4 to prevent removal of the hand tool by a customer until after purchase. The ring 2 is made of a material that is rigid but which has limited flexibility As best seen in FIG. 6, The anti-theft ring 2 is a split ring and is comprised of an annular outer ring 241, an inner ring 231 and an upwardly extending main body 211. The main body 211 is comprised of a plurality of spaced-apart blocks 220 having tapered top edges that form a ridge 221. The blocks 220 are separated by notches 222 which allows the upwardly extending main body 211 to compress under force.

The anti-theft ring 2 is inserted into the opening 411 from the inside of the cover 4, with the ring 2 snapping in place in the opening 411 with the edge of the opening seated beneath the ridge 221 and above the outer ring 241. With the ring 2 thus locked in place, the hand tool 200 with the extension rod 13 attached is inserted through the ring 2 until the inner ring 23 engages the retention groove 211 below the main body 1 of the tool 200. Thus, the hand tool 200 is locked in place with the cover 4.

Once the hand tool 200 is positioned through the opening 411 and combined with the anti-theft ring 2, it cannot be removed from the case 100 once the unit is assembled, the cover 4 is locked to the base 7. This is because the extension rod 23 is seated in the pillar 71, which prevents the hand tool 200 from being pushed further into the cover 4, which would disengage the tool from the anti-theft ring 2.

The removable extension 23 of the hand tool 200 passes through the retainer 6 and combines with a frictional engaging member 72 inside the pillar 71 at the bottom center of the base 7. In an embodiment, the hand tool 200 is a ratcheting driver 200 and the removable extension 23 attached at the ratchet head 3 of the ratcheting driver 200 engages the frictional engaging member 72. The frictional engaging member 72 acts against the direction of rotation of the combined removable extension 23 and ratcheting head 3 so that the function of the ratcheting driver 200 can be tested by the consumer.

After sale, the purchaser can unlock the cover 4 from the base 7 and the anti-theft ring 2 can be removed and may be discarded. The rest of the case 100, including the cover 4 and base 7 form the permanent carrying case 100 for the hand tool 200.

Figure 5:
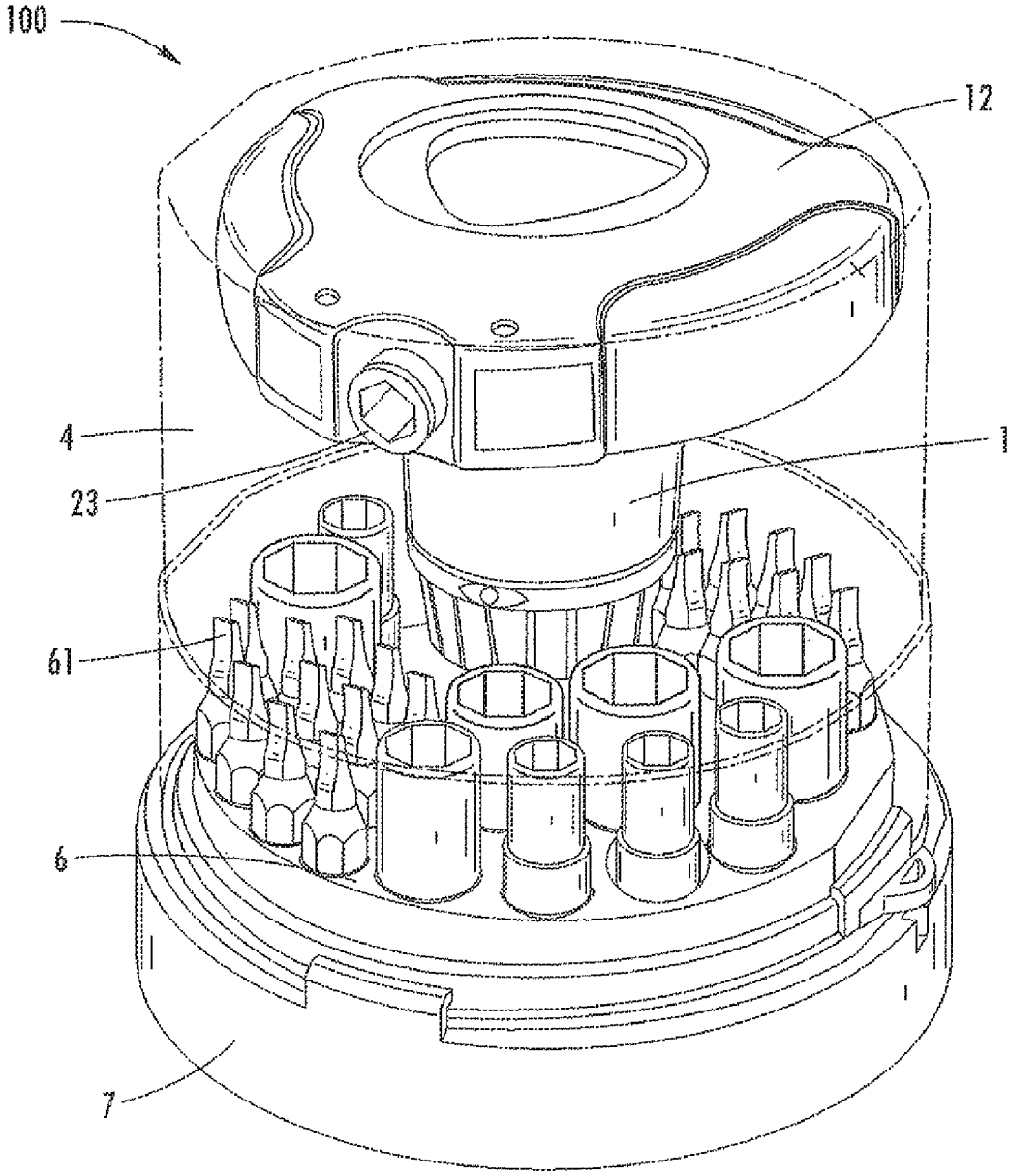
FIG. 5 is a perspective view of the case with the hand tool positioned inside the case.

FIG. 5 illustrates the case 100 holding the hand tool 200 in the second position after purchase and removal of the anti-theft ring 2. The hand tool 200 fits entirely within the cover 4 of the case 100. In the illustrated embodiment, the removable extension 23 of the hand tool 200 is stored within a receptacle 24 extending inside the handle 12. In another embodiment, the extension 23 is received by the retainer 6 and fits in one of the pockets 62 of the retainer 6 along with the interchangeable bits 61. In a further embodiment, the top of handle 12 of the hand tool 200 is formed such that it forms a seal for the opening 411 of the case 100.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. An apparatus comprising:

a case having a base and a cylindrical cover with an aperture in a top of the cover, the cover fits on the base; and a hand tool having a working end and a generally palm shaped handle spaced apart and perpendicular from the working end, wherein the case is adapted to hold the hand tool in a first position with the generally palm shaped handle projecting out of the aperture in the cover of the case a sufficient distance above the cover for fingers of a user's hand to wrap around the generally palm shaped handle and remain above the cover for the case such that the hand tool is prevented from being removed from the case while simultaneously, the generally palm shaped handle can be operated with respect to the case to test a function of the hand tool, and a second position wherein the handle fits within the cover for the case.

2. The apparatus of claim 1, and further comprising an anti-theft device that combines the hand tool with the case to prevent the hand tool from being removed when the hand tool is held in the first position.

3. The apparatus of claim 1, wherein the hand tool is a ratcheting driver.

4. The apparatus of claim 1, wherein the case includes a base adapted to carry interchangeable bits.

5. The apparatus of claim 1, wherein the case is substantially cylindrically shaped.

6. The apparatus of claim 1, wherein the handle is ergonomically shaped.

7. The apparatus of claim 1, wherein the case has a transparent periphery.

8. A display case having a base and a cylindrical cover with an aperture in a top of the cover, the cover fits on the base for holding and displaying a hand tool at a point of sale and storing the hand tool thereafter, the case comprising:

a hand tool having a working end and a generally palm shaped handle spaced apart from and perpendicular to the working end, wherein the case engages the hand tool and holds the hand tool in a first position with the generally palm shaped handle projecting out of the aperture in the cover of the case a sufficient distance above the cover for fingers of a user's hand to wrap around the generally palm shaped handle and remain above the cover for the case such that the handle is prevented from being removed from the case while simultaneously, the handle can be rotated with respect to the case to test a function of the hand tool, and a second position wherein the handle fits within the cover for the case.

9. The case of claim 8, and further comprising an anti-theft device to combine the hand tool with the case.

10. The case of claim 8, wherein the case engages the hand tool in a second position such that the handle fits within the case.

11. The case of claim 8, wherein the hand tool is a ratcheting driver with a head, and the case further comprises a frictional engaging member combined with the case and adapted to engage the head of the ratcheting driver to provide opposition to the direction of rotation of the head of the ratcheting driver to test the function of the ratcheting driver.

12. The case of claim 9, wherein the hand tool is removable from the case when the anti-theft device is removed.

13. The case of claim 8, wherein the case is substantially cylindrically shaped.

14. A case for holding and displaying a hand tool at a point of sale, the case comprising:

a base and a cylindrical cover with an aperture in a top of the cover, the cover fits on the base for storing a hand tool therein a hand tool having a working end and a handle perpendicular to the working end, wherein the case engages the hand tool and holds the hand tool in a first position with the handle projecting out of the aperture in the cover of the case a sufficient distance above the cover for fingers of a user's hand to wrap around the handle and remain above the cover for the case such that the handle is prevented from being removed from the case while simultaneously, the handle can be rotated with respect to the case to test a function of the hand tool and a second position wherein the handle fits within the cover for the case; and a frictional engaging member engaged with the working end of the handle and opposing a direction of rotation of the working end to test a function of the hand tool.

15. The case of claim 14, and further comprising a anti-theft device that combines the hand tool with the case to prevent the hand tool from being removed when the hand tool is held in the first position.

16. The case of claim 15, wherein the case engages the hand tool in a second position such that the handle fits within the case.

17. The case of claim 16, wherein the hand tool is a ratcheting driver.

18. The case of claim 16, wherein the handle is ergonomically shaped.

19. A display tool case, comprising:

a cylindrical base having a receiving area;

a frictional engaging member positioned in the receiving area;

a removable cylindrical cover combined to the base with a top area and an aperture therethrough that is coaxial with the frictional engaging member;

a hand tool having a working end, a main body with an annular ring circumscribing a periphery of the main body, and a generally palm shaped handle spaced apart from the working end, the working end is engaged with the frictional engaging member, the generally palm shaped handle for the hand tool projects out of the aperture in the cover of the case a sufficient distance above the cover for fingers of a user's hand to warp around the generally palm shaped handle and remain above the cover for the case such that the hand tool can be operated with respect to the case to test a function of the hand tool; and an anti-theft ring attached to the aperture of the cover and engaged with the annular ring circumscribing the periphery of the main body of the hand tool to prevent the hand tool from being removed from the case.

20. The display tool case of claim 19, and further comprising a plurality of receptacles positioned around a top of the base to receive a corresponding plurality of interchangeable bits therein.

21. The display tool case of claim 20, and further comprising at least one tab on the cover for the case to engage a corresponding lock on the base to selectively secure the cover to the case to form a permanent carrying case for the hand tool.

22. The display tool case of claim 21, and further comprising a removable cover positioned inside the case below a rib formed in the cover and above the interchangeable bits to prevent the interchangeable bits from falling out of their corresponding receptacle when the case is tipped upside down.

23. The display tool case of claim 22, wherein the cylindrical base and the cylindrical cover have a sufficient depth to receive the hand tool therein.

* * * * *